United States Patent [19]

Gedgoudas et al.

[11] Patent Number: 4,723,632

[45] Date of Patent: Feb. 9, 1988

[54] EXTENSION LADDER ROOF SUPPORT ATTACHMENT

[76] Inventors: Leo C. E. Gedgoudas, Rte. 7, Box 504E, Oxford, Ala. 36203; George Spector, 233 Broadway, Rm. 3815, New York, N.Y. 10007

[21] Appl. No.: 906,522

[22] Filed: Sep. 12, 1986

[51] Int. Cl.[4] ..... E06C 7/48

[52] U.S. Cl. ..... 182/214; 182/206

[58] Field of Search ..... 182/214, 117, 206, 120, 182/121, 122; 248/238

[56] References Cited

U.S. PATENT DOCUMENTS

| | | | |
|---|---|---|---|
| 1,004,284 | 9/1911 | Lehmann | 182/214 |
| 2,680,554 | 6/1954 | Dakin | 248/238 |
| 2,710,129 | 6/1955 | Telech | 182/214 |
| 3,059,721 | 10/1962 | Straw | 182/206 |
| 4,164,269 | 8/1979 | Jackson | 182/206 |
| 4,194,592 | 3/1980 | Evans | 182/214 |
| 4,306,632 | 12/1981 | Brown | 182/214 |
| 4,311,207 | 1/1982 | Lurry | 182/214 |
| 4,331,217 | 5/1982 | Stecklow | 182/214 |
| 4,580,660 | 4/1986 | Oling | 182/214 |

*Primary Examiner*—Reinaldo P. Machado

[57] ABSTRACT

An extension ladder roof support attachment for a ladder that has side rails is provided and consists of a pair of base arms extending from upper portions of said side rails, a pair of angular arms extending from upper portion of said side rails above said base arms and attached to outer ends of said base arms, a cross brace extending diagonally between said angular arms and a stabilizing member extending between said base arms which can sit upon a roof of a building. In a modification the base arms and angular arms are adjustable to various roofs and buildings.

1 Claim, 5 Drawing Figures

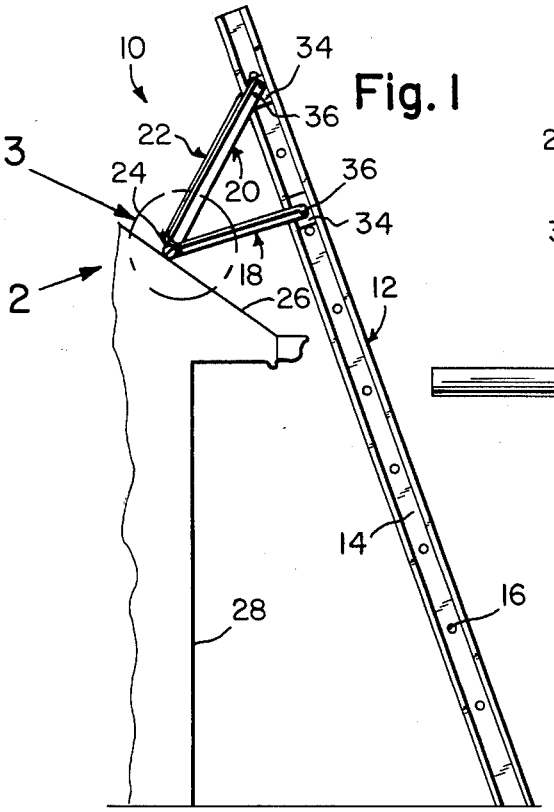
Fig. 1
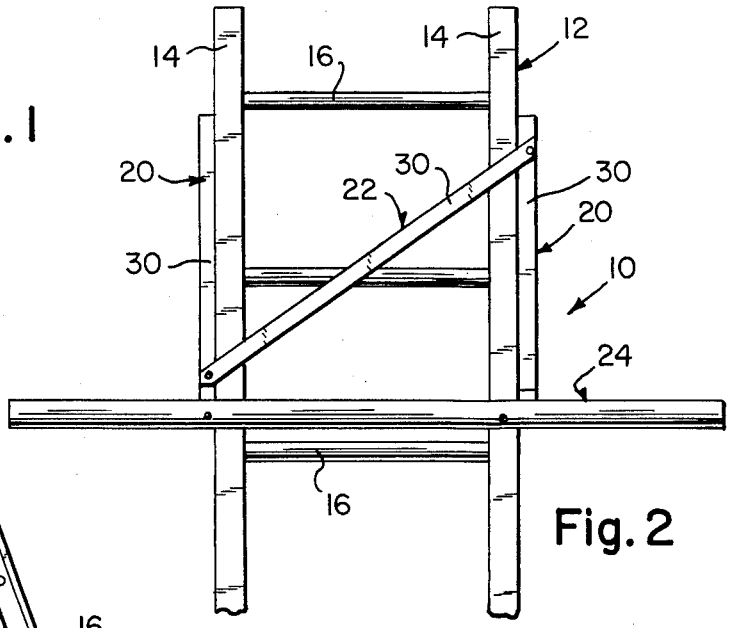
Fig. 2
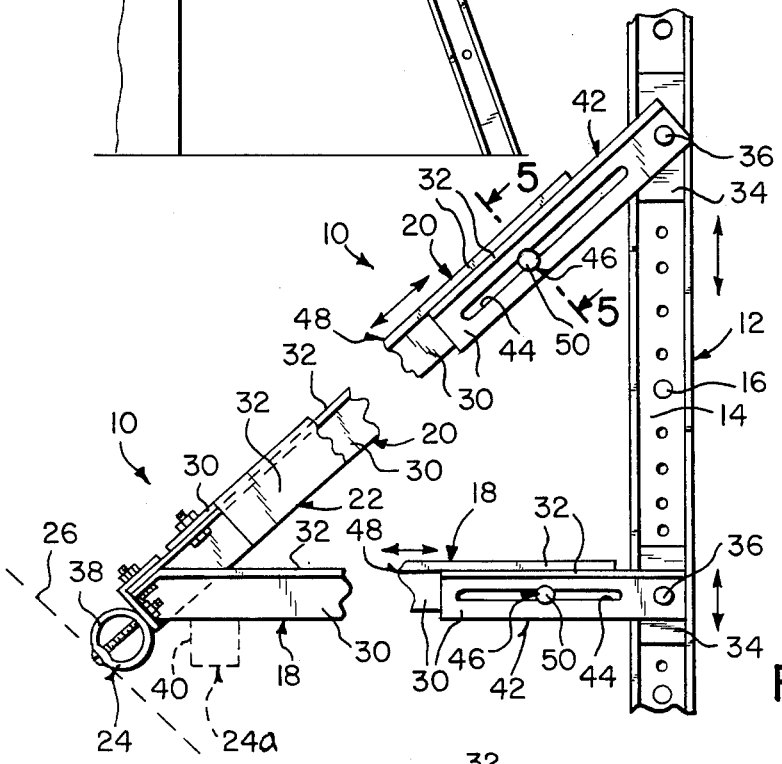
Fig. 4
Fig. 3
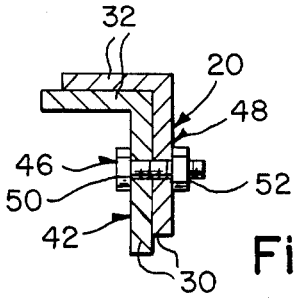
Fig. 5

EXTENSION LADDER ROOF SUPPORT ATTACHMENT

BACKGROUND OF THE INVENTION

The instant invention relates generally to ladder supports and more specifically it relates to an extension ladder roof support attachment.

Numerous ladder supports have been provided in prior art that are adapted to stabilize ladders against buildings. For example, U.S. Pat. Nos. 4,164,269; 4,194,592 and 4,306,632 all are illustrative of such prior art. While these units may be suitable for the particular purpose to which they address, they would not be as suitable for the purposes of the present invention.

SUMMARY OF THE INVENTION

A primary object of the present invention is to provide an extension ladder roof support attachment that will overcome the shortcomings of the prior art devices.

Another object is to provide an extension ladder roof support attachment that makes it possible for a person to set up, ascent/descent and work on a ladder without the assistance from a second person.

An additional object is to provide an extension ladder roof support attachment that is adjustable to various buildings and roof sizes.

A further object is to provide an extension ladder roof support attachment that is simple and easy to use.

A still further object is to provide an extension ladder roof support attachment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a side elevational view of the invention supporting a ladder adjacent to the eave of a building.

FIG. 2 is a fragmentary front view taken in the direction of arrow 2 in FIG. 1.

FIG. 3 is an enlarged detail view as indicated by numeral 3 in FIG. 1.

FIG. 4 is an enlarged detail view being a continuation of FIG. 3 showing the angle arm and base arm being adjustable.

FIG. 5 is an enlarged cross sectional view taken along line 5—5 in FIG. 4 showing the overlapping adjustable L-shaped angles.

DETAILED DESCRIPTION OF THE PREFERRED EMBODIMENTS

Turning now descriptively to the drawings, in which similar reference characters denote similar elements throughout the several views, FIGS. 1 through 3 illustrates an extension ladder roof support attachment 10 for a ladder 12 that has a pair of side rails 14 connected together by a plurality of rungs 16. The attachment 10 consists of a pair of base arms 18, a pair of angular arms 20, a cross brace 22 and a stabilizing member 24.

Each of the base arms 18 is attached at inner end to upper portion of one of the side rails 14 and extends at a right angle therefrom. Each of the angular arms 20 is attached at inner end to the upper portion of one of the side rails 14 above one of the base arms 18. Each of the angular arms 20 extends at an angle downwardly with outer end of the angular arm 20 attached to outer end of one of the base arms 18. The cross brace 22 is attached to and extends from the inner end of one of the angular arms 20 to the outer end of other of the angular arms 20. The stabilizing member 24 is secured to and extends transversely between the outer ends of the base arms 18 whereby the stabilizing member 24 can sit upon a roof 26 of a building 28.

The base arms 18, the angular arms 20 and the cross brace 22 are all fabricated out of elongated L-shaped metal channel members. Each of the channel members have a long leg 30 and a short leg 32 whereby the long leg 30 is used for securing.

The attachment 10 further contains four spacer members 34, each of which is attached to the inner ends of the base arms 18 and the angular arms 20 and thereby attached to the side rails 14 of the ladder 12 by bolts 36.

As best seen in FIG. 3 the stabilizing member 24 consists of an elongated cylindrical metal pipe 38 secured to the outer ends of the base arms 18 at juncture of said angular arms 20. The stabilizing member **24*a* can also consist of an elongated rectangular wooden bar 40, shown in phantom, secured to undersides and adjacent to outer ends of the base arms 18**.

A modification is shown in FIGS. 4 and 5, in which the base arms 18 and the angular arms 20 are adjustable to various lengths so that the attachment 10 can be adjustable to various roof and building sizes. Each of the base arms 18 and the angular arms 20 are segmented and overlapped. One of the segments 42 has an elongated slot 44 in the long leg 30 and is secured to the side rail 14 of the ladder 12. A plurality of fasteners 46 are also provided. Each of the fasteners 46 extends through each one of the slots 44 and into other of the segments 48 so that the segments 42, 48 can be adjusted and then locked into position by the fastener 46. The fastener can be a bolt 50 and nut 52.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An extension ladder roof support attachment for a ladder having a pair of side rails connected together by a plurality of rungs, said attachment comprising:

(a) a pair of base arms, each of said base arms attached at each inner end to an upper portion of one of said side rails and extending at a right angle therefrom;

(b) a pair of angular arms, each of said angular arms attached at inner end to said upper portion of one of said side rails above one of said base arms, each of said angular arms extending at an angle downwardly and having outer ends each attached to each respective outer end of said said base arms, forming triangular parallel frames;

(c) a stabilizing member secured to and extending transversely between said outer ends of said base arms whereby said stabilizing member canbear against a roof of a building;

(d) means for adjusting the length of said angular arms wherein said stabilizing member comprises an elongated cylindrical metal pipe secured to said outer ends of said base arms at juncture of said angular arms, and wherein said means comprise:

(e) each of said base arms and said angular arms being segmented and slidingly over-lapped having slots and terminal portions for adjustable securement to said side rails;

(f) a plurality of fasteners, each of which extends through each one of said slots and into said other of said segments so that said segments can be adjusted and then locked into position by said fastener; and (g) said side rails and terminal portions being provided with means for securing said terminal portions to various positions on said side rails conforming to the adjusted lengths of said base and angular arms.

* * * * *